United States Patent [19]

Osono

[11] Patent Number: 4,820,075

[45] Date of Patent: Apr. 11, 1989

[54] FILING DEVICE

[75] Inventor: Katsuo Osono, Tokyo, Japan

[73] Assignee: King Jim Co. Ltd., Tokyo, Japan

[21] Appl. No.: 22,762

[22] Filed: Mar. 6, 1987

[51] Int. Cl.[4] ..... B42F 13/00; B42F 5/00; B42F 3/02; B42F 13/30

[52] U.S. Cl. ..... 402/79; 402/54; 402/52; 402/48

[58] Field of Search ..... 402/48, 52, 54, 55, 402/56, 57, 70, 71, 74, 75, 79

[56] References Cited

U.S. PATENT DOCUMENTS

| | | | |
|---|---|---|---|
| 1,364,973 | 1/1921 | Auerill | 402/52 |
| 3,977,799 | 8/1976 | Schudy et al. | 502/48 |

FOREIGN PATENT DOCUMENTS

| | | | |
|---|---|---|---|
| 474281 | 3/1929 | Fed. Rep. of Germany | 402/79 |
| 488026 | 12/1929 | Fed. Rep. of Germany | 402/79 |
| 17654 | 12/1913 | United Kingdom | 402/54 |
| 14092 | 6/1916 | United Kingdom | 402/54 |
| 333231 | 8/1930 | United Kingdom | 402/79 |

*Primary Examiner*—Paul A. Bell

*Assistant Examiner*—Paul M. Heyrana Sr.

*Attorney, Agent, or Firm*—Kenyon & Kenyon

[57] ABSTRACT

A filing device provided with a binding element (12) including a file-mounting side edge (16)and a binding portion (18) in the form of a foldable bag adjacent thereto, as well as with a sliding element (14) slidably inserted into the binding portion (18) is disclosed, in which the binding portion (18) is provided in its longitudinal direction with notched guiding grooves (24) spaced apart from each other at a predetermined distance for inserting binder rods (22) from outside and with binding holes (26) adjacent to the grooves (24), while the sliding element (14) is provided in its longitudinal diection with engaging protrusions (28) spaced apart from each other at a predetermined distance for closing and opening the notched guiding grooves (24) of the binding holes (26) and with notched engaging grooves (30) adjacent ot the protrusions (28), said sliding element (14) being further provided at its both ends with stoppers (32) for engaging both ends of the binding element (12) and for limiting the sliding element (14) to a predetermined sliding position.

1 Claim, 2 Drawing Sheets

FILING DEVICE

FIELD OF THE INVENTION

This invention relates to a filing device for binding documents, such as literatures, catalogues or reports, individually kept in their own state and for ensuring convenient and readily filing operation.

BACKGROUND OF THE INVENTION

For filing the documents, heretofore, each document per se has been provided at its one side directly with binding holes, or received in a suitable bag which at its side area in turn is provided with binding holes. These methods, however, require not only a troublesome process for providing the binding holes but also have disadvantages of damaging the document for the former case and of difficultly distinguishing the document externally for the latter case.

In order to solve the above problems, there has been proposed a filing bag, as disclosed in Japanese Opened UM Application 56-18461, wherein the filing bag for receiving document is preliminarily prepared, which at its side edge is provided with notched portions for inserting binder rods and is further provided with a slidable plate moving along the side edge and having notched portions communicated with the first-said notched portions. According to such method, the preliminary preparation of the filing bag permits free filing of the document as well as convenient and readily filing operation simply by opening and closing the notched portions.

The filing device of such type, however, has several points to be improved. Namely, the conventional filing device allows the filing operation only after the documents have been received in the bag. Any document of an elongated shape, however, cannot be smoothly received in the bag and in some serious cases can be slipped off from the bag. Further, even a transparent bag cannot allow correct judgement of the document from outside.

Accordingly, an object of the invention is to provide a filing device for binding documents individually kept in their own state without any damage and for ensuring convenient and readily filing operation.

SUMMARY OF THE INVENTION

In order to achieve the above object, the invention provides a filing device comprising a binding element including a file-mounting side edge and a binding portion in the form of a foldable bag adjacent thereto, as well as a sliding element slidably inserted into the binding portion, in which the binding portion is provided in its longitudinal direction with notched guiding grooves spaced apart from each other at a predetermined distance for inserting binder rods from outside and with binding holes adjacent to the grooves, while the sliding element is provided in its longitudinal direction with engaging protrusions spaced apart from each other at a predetermined distance for closing and opening the notched guiding grooves of the binding holes and with notched engaging grooves adjacent to the protrusions, said sliding element being further provided at its both ends with stoppers for engaging both ends of the binding element and for limiting the sliding element to a predetermined sliding position.

Each document at its side edge is provided with the filing device according to the invention not only for permitting the filing of the document as such but also for ensuring the correct opening and closing operation of the binding holes in the filing device due to the limited sliding movement of the slidable element by the stoppers, resulting in the convenient and simple filing operation.

For better understanding, the invention will now be described herein-below for its preferred embodiments with reference to the accompanying drawings.

PREFERRED EMBODIMENTS OF THE INVENTION

Figure 1:
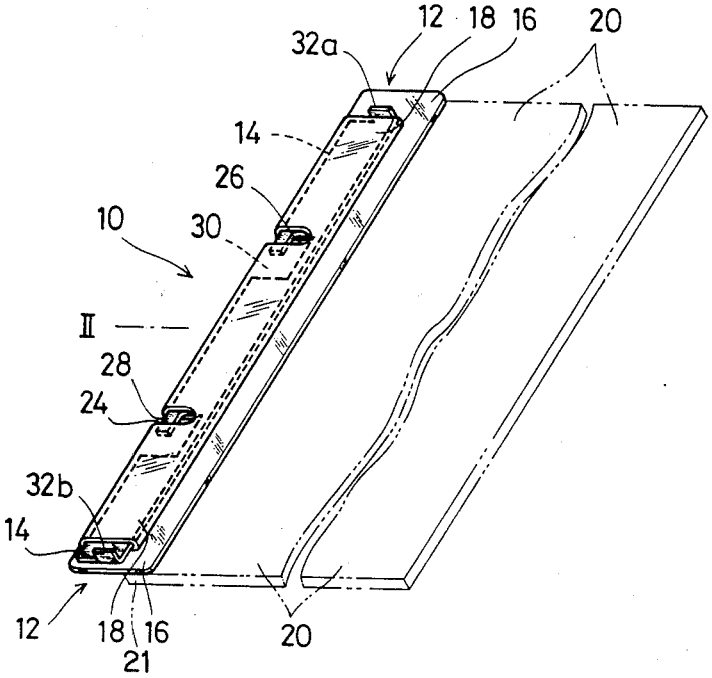
FIG. 1 is a perspective view of one embodiment of the filing device according to the invention.
Figure 2:
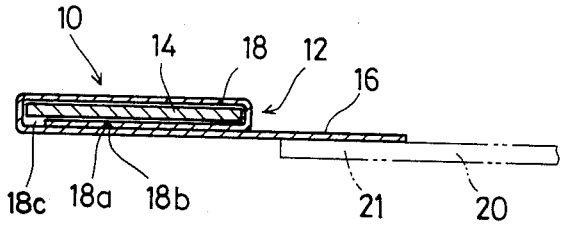
FIG. 2 is an enlarged sectional view of the filing device taken along the line II—II of FIG. 1.

In FIGS. 1 and 2, the filing device 10 according to the invention includes a binding element 12 and a sliding element 14. The binding element 12 may be made of a thick paper material, and comprises a file mounting side edge 16 and a bag shaped binding portion 18 extending therefrom and trebly foldable to form therein an insertion portion 18c. The sliding element 14, on the other hand, may be made of a rigid plastic material having at its ends stoppers 32*a*, 32*b* and is longitudinally inserted into the insertion portion 18*c* of the binding portion 18 slidably. The opposite faces 18*a*, 18*b* of the binding portion 18 are adhered to each other after inserting the sliding element 14 into the insertion portion 18*c* for operation, the filing device 10 thus constructed according to the invention should be used after attached to a side edge 21 of the document 20 to be filed.

Figure 3:
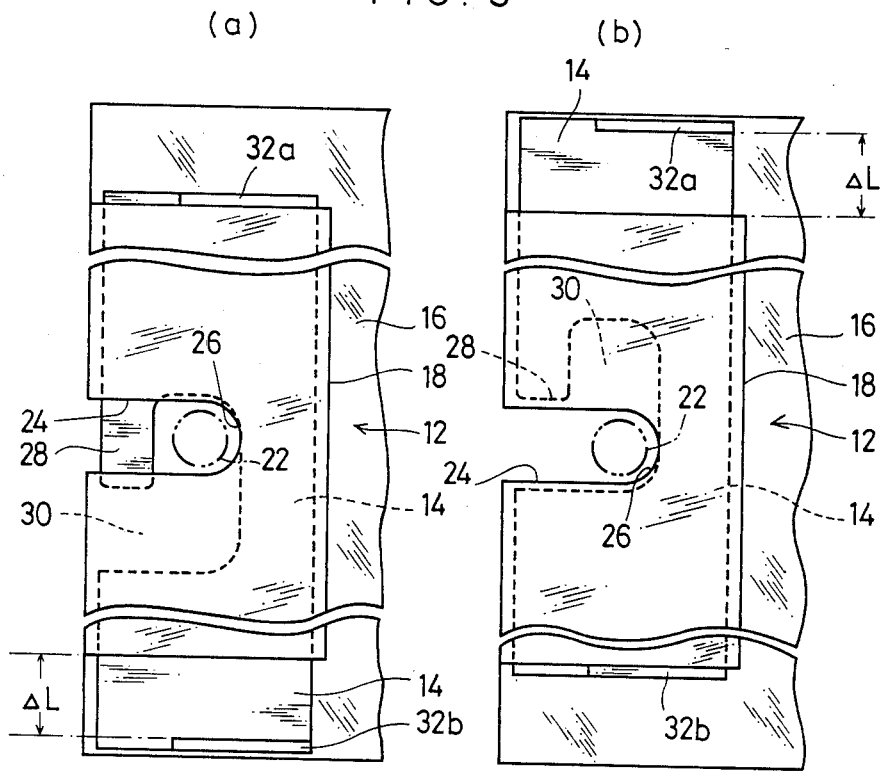
FIGS. 3(*a*) and (*b*) are enlarged plan views of the filing device at its open position and its closed position, respectively.

The construction of the binding portion 18 and the sliding element 14 will now be described with reference to FIGS. 3 (*a*), (*b*). The binding portion 18 is provided in its longitudinal direction with notched guiding grooves 24 spaced apart from each other at a predetermined distance for inserting binder rods 22 from outside and with binding holes 26 adjacent to the grooves 24. The sliding element 14, on the other hand, is provided in its longitudinal direction and at positions corresponding to the binding holes 26 with engaging protrusions 28 for opening and closing the grooves 24 and with notched engaging grooves 30 adjacent to the protrusions 28. Further, the sliding element 14 at its both ends is provided with two stoppers 32*a*, 32*b* of upright pieces for engaging both ends of the binding element 12 and for limiting the sliding element 14 to its predetermined sliding position of correctly closing and opening the binding holes 26. FIG. 3 (*a*) shows a position in which one stopper 32*a* is engaged with one end face of the binding portion 18 to close the binding holes 26, while FIG. 3(b) shows another position in which the other stopper 32*b* is engaged with the other end face of the binding portion 18 to open the binding holes 26. Either the stopper 32*b* in the former position or the stopper 32*a* in the latter position is spaced apart from the end face of the binding portion 18 at a distance $\Delta L$ for limiting the sliding movement. The stoppers 32 may be advantageously utilized for withdrawing or pushing the sliding element 14 relative to the binding portion 18.

Figure 4:
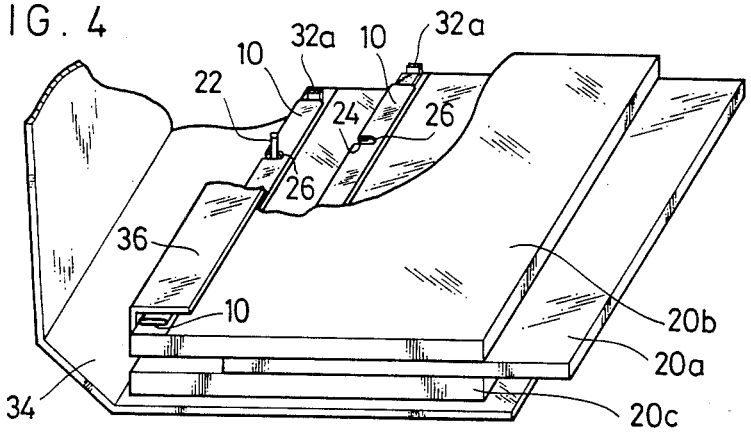
FIG. 4 is a perspective view of the document provided with the filing device of FIG. 1 for showing its filing operation.

The filing operation of the documents 20 using the filing device 10 according to the invention will now be described with reference to FIG. 4. As can be seen from FIG. 4, the filing device 10 is attached to each of the documents 20 at its side area and filed by the binder rods 22 of a file 34. When only an intermediate document 20*a* is removed from a space between upper and lower documents 20*b* and 20*c*, the intermediate document 20*a* having its upper stopper 32*a* pulled upwardly for opening the notched guiding grooves 24 of the binding holes 26 may be conveniently withdrawn without opening a binder 36. The upper stoppers 32*a* for the documents 20*b* and 20*c*, however, are kept in their pushed down position for closing the binding holes 26, thereby to prevent these documents 20*b*, 20*c* from being withdrawn. Conversely, when the document 20*a* should be filed, it may be pushed toward the binder rods 22 for allowing the latter to be inserted into the notched guiding grooves 24 and then the stopper 32*a* is pushed downward for allowing the engaging protrusions 28 to close the grooves 24, thereby to confine the binder rods 22 within the binding holes 26. Thus, the document 20*a* may be filed very conveniently without opening the binder 36.

As described herein-above, the filing device according to the invention comprises the binding element including the file-mounting side edge and the binding portion in the form of a foldable bag adjacent thereto, as well as the sliding element slidably inserted into the binding portion, in which the binding portion is provided in its longitudinal direction with the notched guiding grooves spaced apart from each other at a predetermined distance for inserting the binder rods from outside and with the binding holes adjacent to the grooves, while the sliding element is provided in its longitudinal direction with the engaging protrusions spaced apart from each other at a predetermined distance for closing and opening the notched guiding grooves of the binding holes and with the notched engaging grooves adjacent to the protrusions, said sliding element being further provided at its both ends with the stoppers for engaging both ends of the binding element and for limiting the sliding element to a predetermined sliding position. Thus, each document at its side area may be provided with the filing device according to the invention, thereby to enable the filing operation only for the required document selectively. Further, the filing operation may be very simple and convenient because the sliding element may be limited in its sliding movement to the predetermined position by the stoppers. Thus, the important documents, such as literatures, catalogues or reports, may be maintained individually and systematically in their own state without any damage and may be handled by the very convenient and readily operation.

What is claimed is:

1. A filing device comprising:

a binding element (12) comprising a file mounting side edge (16) for communicating with a document (20) and a binding portion (18) extending from said file mounting side edge and trebly folded to form a longitudinal cavity (18c) with a sliding element (14) therein, said binding portion (18) having a plurality of guiding grooves (24) spaced apart from each other at a predetermined distance to guide binding rods (22) to a plurality of binding holes (26) located in said binding portion (18) adjacent to said guiding grooves (24); and said sliding element (14) comprising a first position having means for guiding said binding rods to said binding holes, and a second position having means for closing said guiding grooves (24) thereby fixing said binder rods (22) in said binding holes (26), said sliding element (14) being further provided at both ends with means for moving the sliding element from said first position to said second position and for limiting said sliding element (14) to a plurality of predetermined positions in said cavity.

* * * * *